United States Patent [19]

Rovani

[11] 4,023,213

[45] May 17, 1977

[54] SHOCK-ABSORBING SYSTEM FOR PROTECTIVE EQUIPMENT

[75] Inventor: William Rovani, Chicago, Ill.

[73] Assignee: Pepsico, Inc., Purchase, N.Y.

[22] Filed: May 17, 1976

[21] Appl. No.: 686,725

[52] U.S. Cl. ..... 2/413

[51] Int. Cl.[2] ..... A42B 3/02

[58] Field of Search ..... 2/411, 412, 413, 414, 2/417

[56] References Cited

UNITED STATES PATENTS

| | | | |
|---|---|---|---|
| 3,039,109 | 6/1962 | Simpson | 2/413 |
| 3,609,764 | 10/1971 | Morgan | 2/414 |
| 3,761,959 | 10/1973 | Dunning | 2/413 |
| 3,849,801 | 11/1974 | Holt et al. | 2/413 |

*Primary Examiner*—Alfred R. Guest
*Attorney, Agent, or Firm*—Hill, Gross, Simpson, Van Santen, Steadman, Chiara & Simpson

[57] ABSTRACT

A shock-absorbing system is provided for protective helmets such as football helmets or crash helmets which includes an impact-resistant shell, a plurality of webs secured to the inside of the shell in the crown portion, and a plurality of flexible plastic compartments containing foam secured to the webs, the compartments being interconnected by means of orifices of relatively small size and the interior of the compartments being at atmospheric pressure or slightly above.

7 Claims, 7 Drawing Figures

Fig. 1
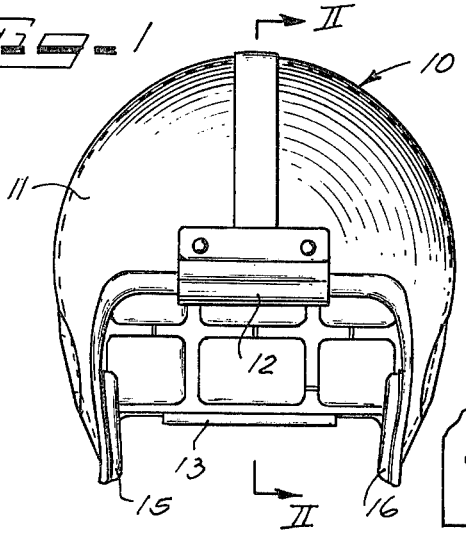
Fig. 4
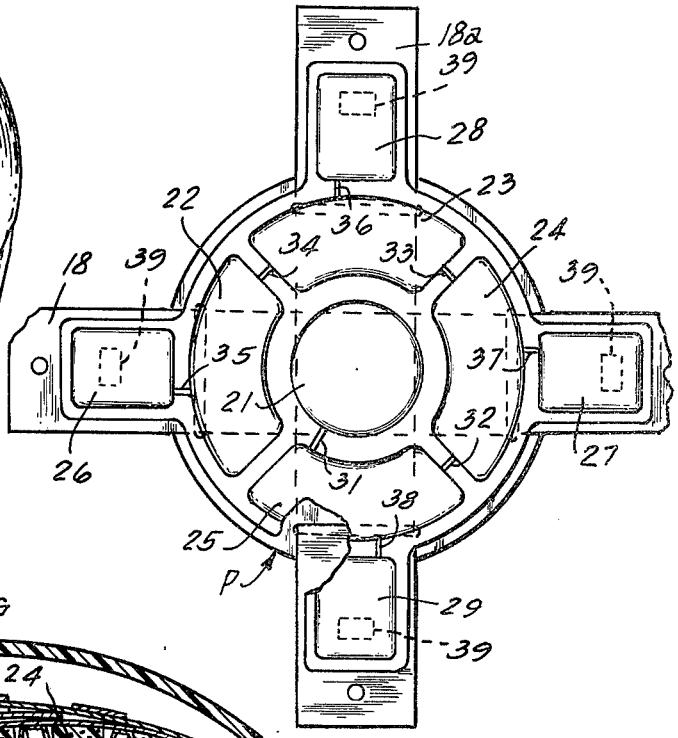
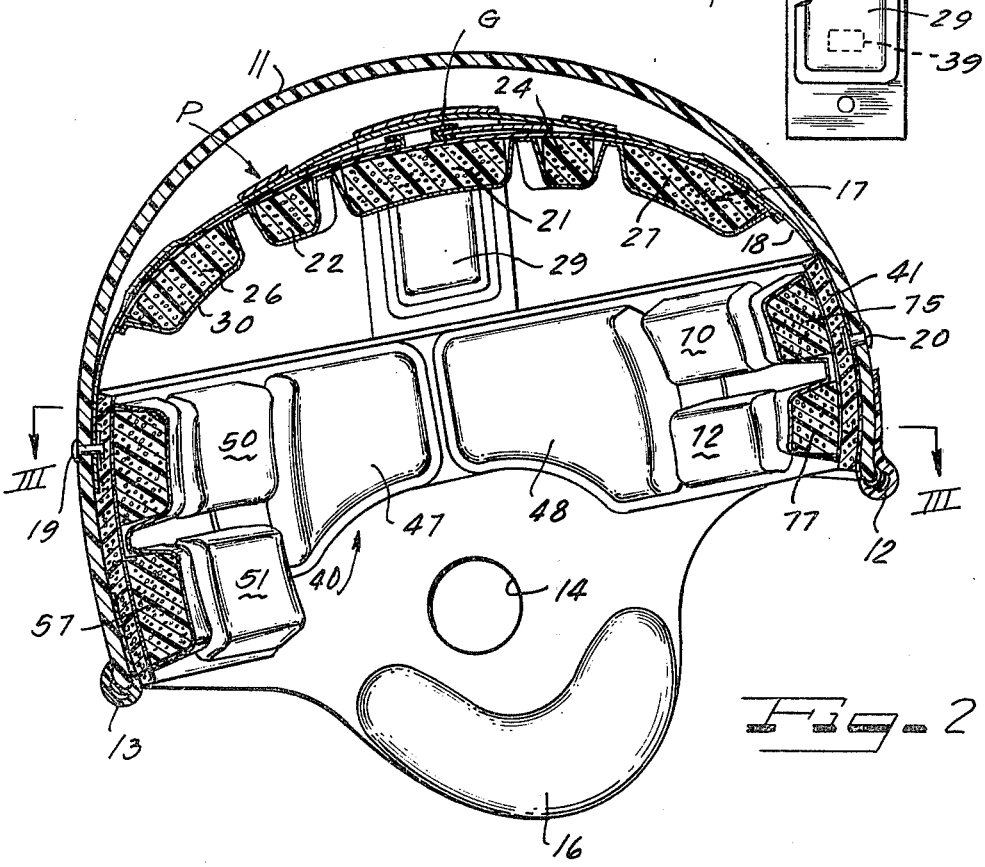
Fig. 2

SHOCK-ABSORBING SYSTEM FOR PROTECTIVE EQUIPMENT

BACKGROUND OF THE INVENTION

1. Field of the Invention

This invention is in the field of protective, shock-absorbing helmets having liners therein which function to absorb shock and to dampen the shock thereby reducing the possibility of injury to the wearer.

2. Description of the Prior Art

Football helmets and other types of shock-absorbing headwear must be provided with internal padding. Frequently, this padding took the form of a resinous foam which was covered with soft leather, the padding being conformed to fit the head, and consisting of replaceable front, back and rear sections.

SUMMARY OF THE INVENTION

The present invention provides a protective shock-absorbing helmet including an impact-resistant shell composed of a polycarbonate resin or similar impact-resistant material, with a plurality of webs secured to the inside of the crown of the shell. These webs carry a plurality of spaced, flexible compartments secured thereto, the compartments being interconnected for fluid passage by means of orifices each of which has a cross-sectional area from 0.0005 to 0.0012 square inches (0.0032 to 0.0077 square centimeters). Preferably, the cross-sectional area of the orifices ranges from about 0.0005 to 0.0008 square inches (0.0032 to 0.0052 square centimeters). These compartments extend along the sides of the helmet and also bridge across the top of the helmet. The compartments preferably include blocks of open or closed cell rubber latex foam or a synthetic resin foam such as a polyurethane. The compartments constitute a pressurized interconnected network, whereby a blow sustained on one portion of the helmet causes a redistribution of air through the entire series of compartments, thereby substantially absorbing the shock and dampening the shock. The compartments are preferably at a positive pressure of from atmospheric to about 3 psi gauge ($2.1 \times 10^3$ kg per mm. sq.)

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a view in elevation of an improved football helmet embodying the improvements of the present invention;

FIG. 2 is a cross-sectional view on a somewhat enlarged scale taken substantially along the line II—II of FIG. 1;

FIG. 4 is a plan view looking into the interior of the crown of the helmet, with a portion broken away to illustrate the structure;

DESCRIPTION OF THE PREFERRED EMBODIMENTS

Figure 3:
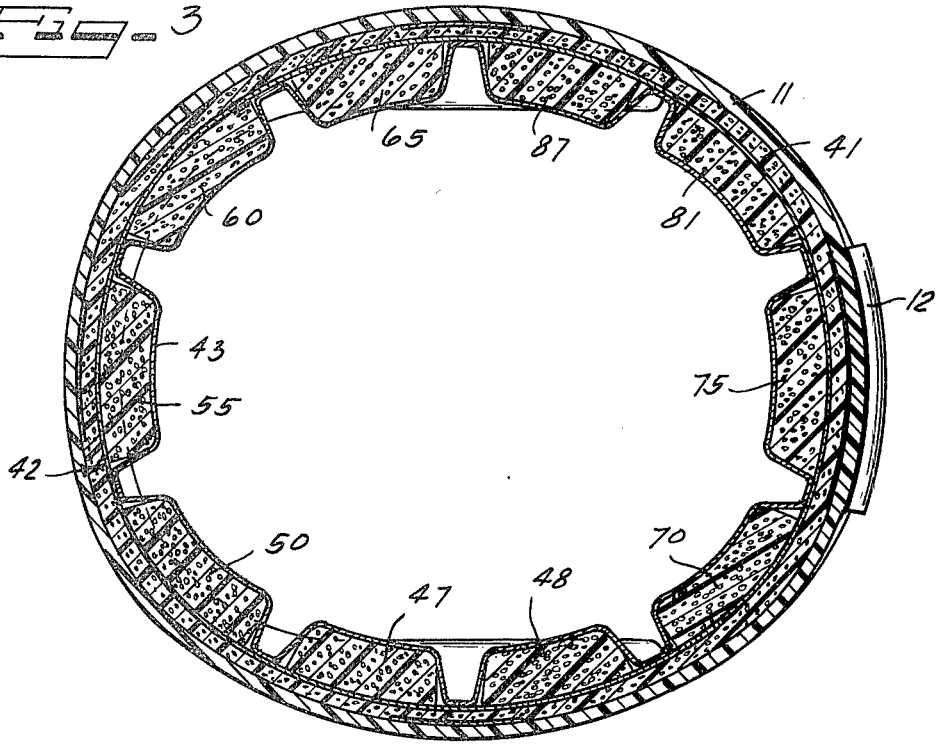
FIG. 3 is a cross-sectional view taken substantially along the line III—III of FIG. 2.

In FIG. 1, reference numeral 10 indicates generally a football helmet of the type which is being used currently. Such helmet includes a shell 11 composed of a strong, impact-resistant resin such as a polycarbonate, acrylonitrile-butadiene-styrene, or other resin. A front nose bumper 12 composed of a resilient material such as rubber or synthetic resin is secured to the front of the helmet, and a rear neck bumper 13 of a similar material is secured to the back of the helmet. The sides of the helmet are provided with ear holes 14 and jaw pads 15 and 16 at opposite sides thereof to provide a shock-absorbent means for protecting both sides of the jaw.

Within the plastic shell 11 there is provided a crown module generally indicated at reference numeral 17. This module is suspended internally of the shell on a rigid plastic crown plate P which is ploted as shown in FIG. 4 to receive the intersecting webs 18 and 18a composed of spun or woven fibers. Rivets 19 and 20 secure the ends of the webs to the helmet shell.

The crown module 17 includes a plurality of shock-absorbing, foam-filled compartments including a centrally located generally circular compartment 21 surrounded by peripheral, arcuate compartments 22, 23, 24 and 25. Additional compartments 26, 27, 28 and 29 are provided along the web in the front and back, as well as the side portions.

The module has a base sheet which may consist of a heat sealable thermoplastic resin of the vinyl type secured to the web 18 as by means of "Velcro" fasteners 39. The same type of fastener may be used to fasten the crown module 17 to the webs 18 and 18*a*. The center of the crown module 17 is secured to a central hole in the crown plate P by means of a grommet G. A vacuum formed cover sheet 30 also composed of a heat sealable resin confines the individual pieces of foam within the compartments 21, 22, 23, 24, 25, 26, 27, 28 and 29. The foam may be a natural latex foam or it may be a synthetic resin foam such as a polyurethane.

There is limited fluid communication provided between the various compartments, the purpose of which is to provide a tortuous path for air between the various compartments. Consequently, a blow at one place in the network of compartments redistributes air through the others, but with a substantial resistance to air flow. Such resistance is provided by means of a series of orifices which provide a tortuous path for air passing between the individual compartments. In FIG. 4, these orifices include an orifice 31 between the central compartment 21 and the compartment 25, an orifice 32 between compartment 24 and compartment 25, an orifice 33 between compartment 24 and compartment 23, and an orifice 34 between compartment 23 and compartment 22. Likewise, the restricted orifice 35 connects compartment 26 to compartment 22, a restricted orifice 36 connects compartment 23 with compartment 28, a restricted orifice 37 connects compartment 24 with compartment 27, and a restricted orifice 38 connects compartment 25 with compartment 29.

Figure 7:
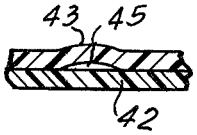
FIG. 7 is a cross-sectional view taken substantially along the line VII—VII of FIG. 6.
Figure 6:
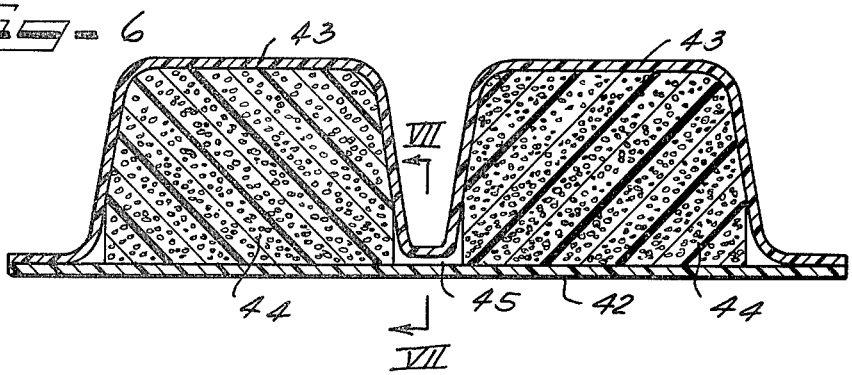
FIG. 6 is an enlarged view of two adjacent compartments with an orifice between them.

Protection for the sides of the head is afforded by a shock-absorbing liner generally indicated at reference numeral 40. This liner 40 is secured to a foam-sizing liner 41 which completely encircles the interior of a shell 11, as shown in FIG. 3. The liner itself includes a base sheet 42 (FIG. 6) composed of a heat-sealable resin such as a vinyl resin. To the base sheet 42 at spaced intervals there is heat sealed or otherwise secured a heat-sealable, vacuum-formed cover sheet 43. A plurality of foam inserts 44 provide flexible, shock-absorbing compartments, with an elongated orifice 45 extending between adjoining compartments as best illustrated in FIGS. 6 and 7 of the drawings. The cross-sectional area of each of the orifices is in the range from 0.0005 to 0.0012 square inches (0.0032 to 0.0077 centimeters) and is preferably in the range from 0.0005 to 0.0008 square inches (0.0032 to 0.0052 square centimeters).

Figure 5:
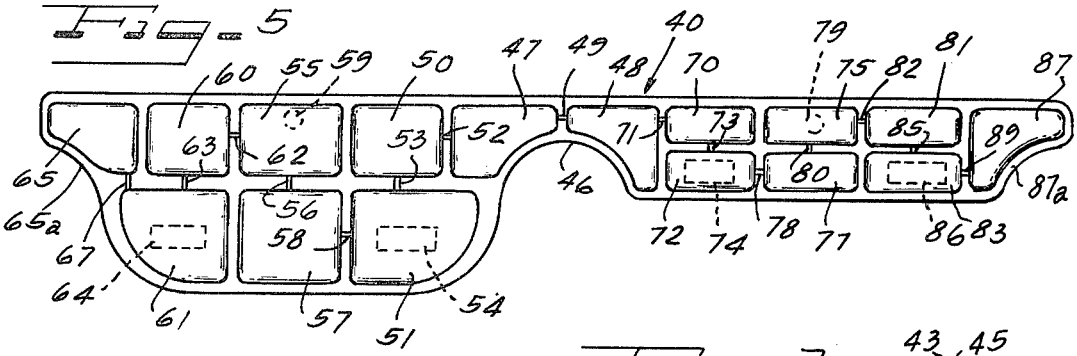
FIG. 5 is a view in elevation of a liner which can be used in the helmet of the present invention.

A development of a suitable liner for the helmet is shown in FIG. 5. This particular liner uses a one-piece construction, but it should be appreciated that the liner may be made up of two or more segments. The liner 40 includes a recessed portion 46 which fits around an ear of the wearer. A pair of compartments 47 and 48 are located just above the ear recess and may be interconnected by means of an orifice 49. Moving toward the back of the helmet the comparment 47 communicates with a compartment 50 by means of a restricted orifice 52, and compartment 50 communicates with adjoining compartments 51 through an orifice 53. A "Velcro" fastener 54 may be provided on the base sheet 42 to secure the same to the sizing liner 41. Compartment 51 communicates with another compartment 57 by means of a restricted orifice 58, while compartment 57 communicates with an adjoining compartment 55 by means of an orifice 56.

A plastic button 59 is carried by the base sheet 42 for the purpose of locating and fastening the liner to the helmet shell. Proceeding rearward, another compartment 60 communicates with compartment 55 through orifice 62. Compartment 60, in turn, communicates with compartment 61 by means of orifice 63. A "Velcro" fastener 64 is provided on base sheet 42 in conjunction with compartment 61. Finally, the rearmost compartment 65 communicates with compartment 61 by means of an orifice 67.

Moving toward the front of the helmet, compartment 48 communicates with compartment 70 through a restricted orifice 71, the compartment 70 communicating to a lower compartment 72 by means of a restricted orifice 73. A "Velcro" type fastener 74 is provided on base sheet 42 in conjunction with compartment 72 for fastening purposes. Compartment 72 communicates with compartment 77 through a restricted orifice 78, while compartment 77 communicates with a compartment 75 by means of a restricted orifice 80. A plastic button 79 or the like is provided on base sheet 42 for locating and fastening the liner. Fluid communication between compartments 75 and 81 may be provided by means of a restricted orifice 82.

Compartment 81 communicates with lower adjoining compartment 83 by means of an orifice 85. Similarly, compartment 83 communicates with a compartment 87 by means of a restricted orifice 89. A "Velcro" fastener 86 may be provided on base sheet 42 at compartment 83. An arcuate surface 87*a* cooperates with an arcuate surface 65*a* of compartment 65 to define a second ear portion for the liner.

It should be noted that each liner which engages the side of the head, and shown in FIG. 5, has compartments which have no more than two orifices. Consequently, when air enters through one orifice in a compartment, it must leave by the other.

The liners can be pressurized before insertion into the helmet. The optimum range of pressurization is from 0 to 3 pounds psi gauge (up to $2.1 \times 10^{-3}$kg/mm$^2$). At pressures below 0 pound per square inch gauge, there is not sufficient shock attenuation while with pressures greater than 3 psi gauge, there can be fit and comfort problems.

The flexible, collapsible compartments of the present invention may contain either open or closed cell foam, or a combination of both. When the helmet of the present invention is impacted, a flow of air commences between adjoining compartments through the restricted orifices providing a tortuous path for air flow and resulting in viscous damping of the impact. The impact is further cushioned by the compressibility of the air within the system. Flow of air through the open cell foam in any given compartment further accentuates the viscous damping and the compressibility of the foam also adds to the ability of the material to attenuate shock.

The shock attenuating system of the present invention can be used for athletic helmets, crash helmets, body protectors or the like or in whatever system requires increased shock attenuation with rapid recovery, light weight and user comfort.

It should be understood that various modifications can be made to the described embodiments without departing from the scope of the present invention.

I claim as my invention:

1. A protective shock-absorbing helmet comprising an impact resistant shell having a crown thereon, a plurality of webs secured to the inside of said crown and including a pair of webs arranged to engage the sides of the wearer's head, and a plurality of flexible foam-containing compartments secured to said webs, said compartments being interconnected by means of orifices each having a cross-sectional area of from 0.0005 to 0.0012 square inches (0.0032 to 0.0077 square centimeters), said pair of webs which engages the sides of the wearer's head having compartments all of which are connected to adjacent compartments by no more than two orifices.

2. The helmet of claim 1 in which each of said orifices has a cross-sectional area of from 0.0005 to 0.0008 square inches (0.0032 to 0.0052 square centimeters).

3. The helmet of claim 1 in which the compartments are at a positive pressure of from atmospheric to 3 pounds per square inch gauge ($2.1 \times 10^{-3}$kg/mm$^2$).

4. The helmet of claim 1 in which said foam is a synthetic resin foam.

5. The helmet of claim 1 in which said foam is a rubber foam.

6. The helmet of claim 1 in which said foam compartments consist of a flexible foam encased in a synthetic resin sheet.

7. The helmet of claim 6 in which said foam compartments consist of individual pieces of foam confined between two synthetic resin sheets, the sheets being heat sealed together along spaced portions thereof.

* * * * *